United States Patent [19]

Bergero et al.

[11] Patent Number: 4,973,924

[45] Date of Patent: Nov. 27, 1990

[54] MODE CONVERTER FOR MICROWAVE POWER TRANSMISSION CIRCUIT

[75] Inventors: Jean-Pierre Bergero, Limeil Brevannes; Claude Couasnard, Meudon La Foret, both of France

[73] Assignee: Thomson-CSF, Paris, France

[21] Appl. No.: 312,762

[22] Filed: Feb. 21, 1989

[30] Foreign Application Priority Data

Feb. 23, 1988 [FR] France ..... 880216

[51] Int. Cl.[5] ..... H01P 1/163

[52] U.S. Cl. ..... 333/21 R; 333/137; 333/248

[58] Field of Search ..... 333/21 R, 21 A, 125, 333/137, 248, 254

[56] References Cited

U.S. PATENT DOCUMENTS

| | | | |
|---|---|---|---|
| 2,455,158 | 11/1948 | Bradley . | |
| 2,816,271 | 12/1957 | Barker | 333/21 R X |
| 2,825,031 | 2/1958 | Parisi . | |
| 2,859,412 | 11/1958 | Marie | 333/21 R |
| 3,435,380 | 3/1969 | Billon et al. . | |
| 3,633,130 | 1/1972 | Ajioka . | |
| 3,651,435 | 3/1972 | Riblet | 333/21 A X |
| 3,665,481 | 5/1972 | Low et al. . | |
| 4,679,008 | 7/1987 | Irzinski et al. | 333/249 X |

FOREIGN PATENT DOCUMENTS 1314408 12/1962 France .

OTHER PUBLICATIONS

International Journal of Electronics, vol. 57, No. 6, Dec. 1984, pp. 1219–1224; G. Janzen.

*Primary Examiner*—Paul Gensler

*Attorney, Agent, or Firm*—Oblon, Spivak, McClelland, Maier, & Neustadt

[57] ABSTRACT

The converter disclosed is interposed between a generator of electromagnetic waves and circular, output waveguide propagating the $TE_{01}$ mode. It is formed by the series mounting of a rectangular waveguide, having one of its end closed and a circular waveguide propagating the $TM_{01}$ mode, connected to the rectangular waveguide by a lateral opening, in such a way that the axes of the two waveguides are perpendiuclar, also included in the series mounting is a group of intermediate waveguides placed after the circular waveguide, distributed in a ring before its free end. Each intermediate waveguide is formed by a sequence of waveguide pieces working in the rectangular $TE_{10}$ mode and gradually offset in rotation with respect to one another, in the same direction. The overall offset among the pieces of one and the same intermediate guide will be 90°. The converter can be applied to the conversion of modes in high power microwave transmission circuits.

7 Claims, 4 Drawing Sheets

SECTION A-A'

SECTION B-B'

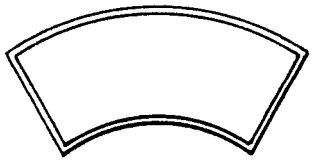
FIG. 3a
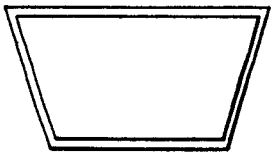
FIG. 3b
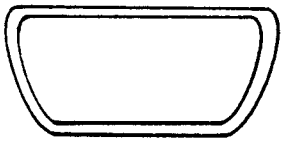
FIG. 3c
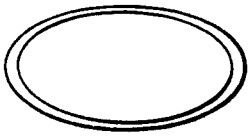
FIG. 3d
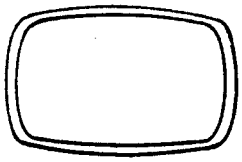
FIG. 3e
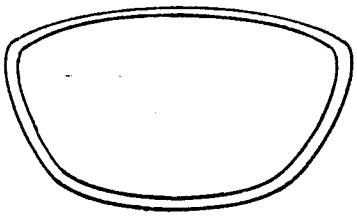
3f
FIG_5
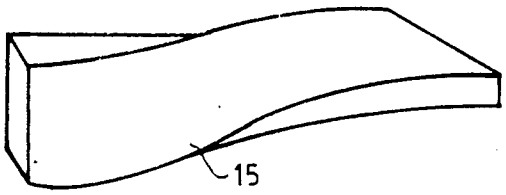

MODE CONVERTER FOR MICROWAVE POWER TRANSMISSION CIRCUIT

BACKGROUND OF THE INVENTION

1. Field of the Invention

The present invention concerns a mode converter for a microwave power transmission circuit.

2. Description of the Prior Art

The techniques associated with high power millimetric and centrimetric waves are currently undergoing development because of generators and amplifiers such as gyrotrons, etc. The waveguides used are over-sized so as to enable the transmission of the necessary power and reduce transmission losses because the electrical fields vary in proportion to the square root of the power transmitted and in inverse proportion to the square root of the guide section.

Furthermore, if the dimensions of the guide are too great, for a given working frequency, several propagations modes can be created. This is unacceptable because of losses by conversion of unwanted modes. A compromise should be made between the dimensions of the guide and the power to be transmitted.

Present-day microwave power transmission circuits generally consist of elements each working in different propagation modes. For example, these elements may be a generator in $TE_{02}$ mode, a transmission line in $TE_{01}$ mode and an excited antenna in $TE_{11}$ mode.

To connect these elements, therefore, the output mode of one element must be converted into the mode of the following element.

There already exists a number of mode converters. These are of different types, depending on the level of power to be transmitted.

Converters for low power levels are generally used for conversion from the rectangular $TE_{10}$ mode to the circular $TE_{01}$ mode. Owing to the low power to be transmitted, the guides are not over-sized. According to a first technique, the circular, output waveguide is coupled to the rectangular, input waveguide by means of holes located on the small side of the rectangular guide, so as to excite the desired mode in the circular, output guide. These devices cannot be used at high power.

Another method used to achieve conversion is to gradually change the shape of a rectangular guide to obtain a circular guide that propagates the $TE_{01}$ mode.

These devices cannot be used when the circular guide is over-sized for the $TE_{01}$ mode, and they are very long.

Prior art types of mode converter devices for high power are made by the cascade connection of several elements.

The shape of the rectangular section waveguide, propagating the $TE_{01}$ mode, is gradually changed to obtain a monomode, circular section guide propagating the $TE_{11}$ mode. The diameter of the circular waveguide is gradually increased so as to enable transmission of the necessary power. The transition from the $TE_{11}$ mode to the $TE_{01}$ mode is obtained by periodic changes in the shape of the walls of the guide. The periodicity of the changes in shape is equal to the beat wavelength between the input mode and the output mode of the circular guide. These converters have the drawback of being some meters long and of being costly, because it is difficult to make these changes in shape. They also have the drawback of having a very narrow pass-band.

The present invention provides a particularly simple approach for making a mode converter for microwave power transmission circuits. This device enables the conversion of the rectangular $TE_{10}$ mode into the circular $TE_{01}$ mode. This converter can be used to transmit high power, and the mode obtained at output has high purity. Its length is reduced, which is the goal sought.

SUMMARY OF THE INVENTION

According to the invention, there is proposed a mode converter for microwave power transmission circuits, working at high power, interposed between an electromagnetic wave generator and a circular, output waveguide propagating the circular $TE_{01}$ mode, said converter comprising:

a rectangular waveguide, working in its fundamental mode, $TE_{10}$, connected by one of its ends to the electromagnetic wave generator and having its other end closed;

a circular waveguide propagating the $TM_{01}$ mode, having a first end connected to the rectangular a waveguide by a lateral opening, located on the large side of the rectangular waveguide near its closed end in it such a way that the axes of the two waveguides are perpendicular, said device comprising:

a group of intermediate waveguides, distributed in a ring before a second end of the circular waveguide, each of these intermediate waveguides consisting of a sequence of waveguide sections (hereinafter called "pieces") working in the rectangular $TE_{10}$ mode, the large sides of their cross-sections being gradually offset rotationally with respect to one other, in the same direction, in such a way that the first piece of each intermediate waveguide has at least one of its large sides cut in a substantially perpendicular direction by a radius of the circular waveguide, and in such a way that the overall offset between the first piece and the last piece of one and the same intermediate waveguide is 90°.

According to a first embodiment, each intermediate waveguide will comprise three waveguide pieces, placed end to end, the angle of rotation of the second piece with respect to the first piece being 45°, and the angle of rotation of the third piece with respect to the first one being 90°. According to another embodiment, each intermediate guide will consist of a single guide, twisted by 90° continuously around its axis, and all the intermediate waveguides will be twisted with the same pitch and in the same direction.

BRIEF DESCRIPTION OF THE DRAWINGS

Other characteristics of the invention will appear from the following description illustrated by the appended figures, of which:

FIGS. 3*a* to 3*f* show various possible sections for the intermediate waveguide pieces;

FIG. 5 shows a continuously twisted intermediate waveguide.

In these figures, the same references are repeated for the same elements. The proportions between the different elements are not maintained, with a view to clarity.

DESCRIPTION OF PREFERRED EMBODIMENTS

Figure 1:
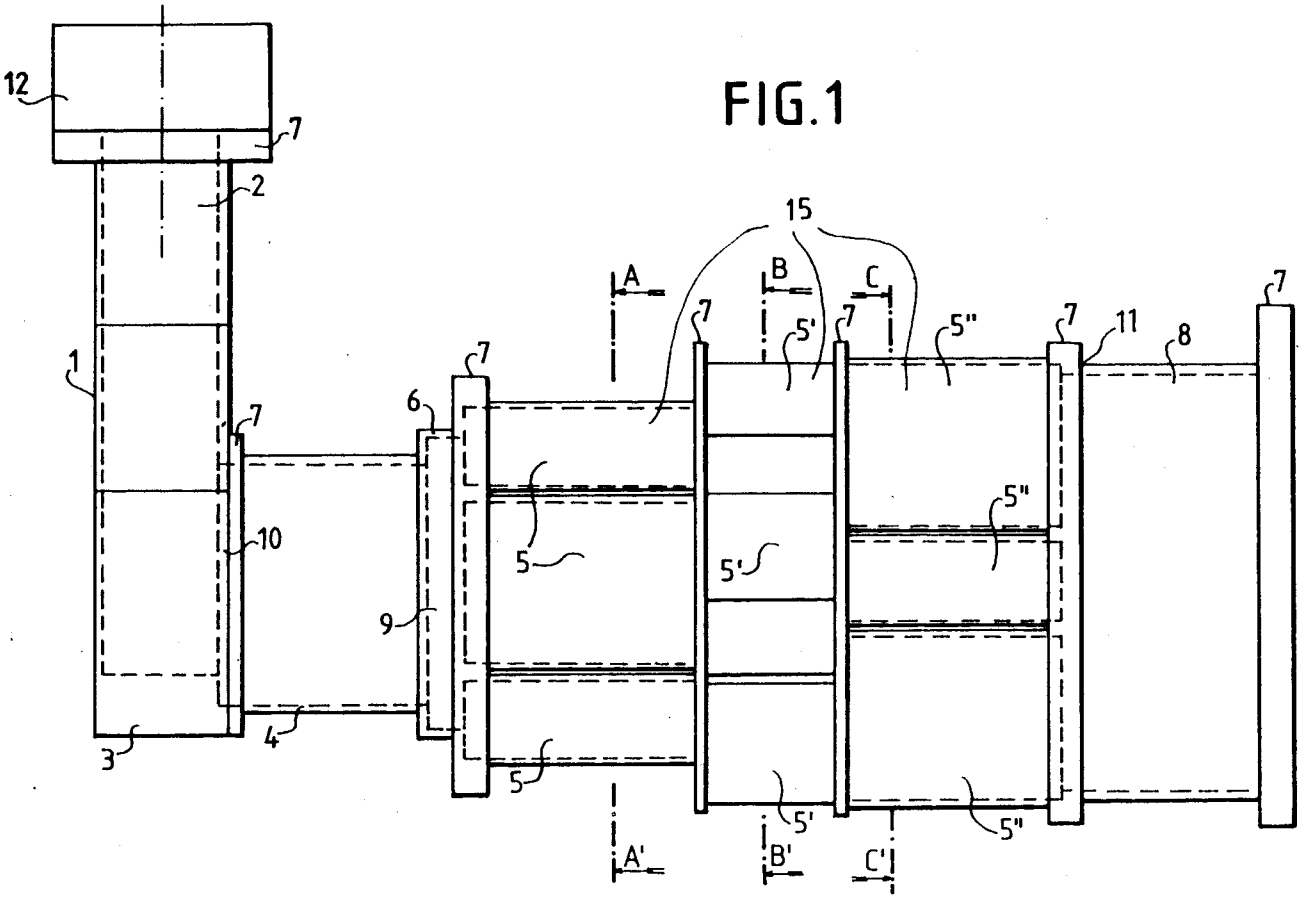
FIG. 1 shows a longitudinal section of a mode converter according to the invention.

FIG. 1 shows a sectional view of the mode converter according to the invention.

This mode converter is formed by the juxtaposition of different elements.

The first of these elements is a waveguide 1 with a rectangular section, working in its fundamental mode, namely the $TE_{10}$ mode.

The waveguide 1 is excited by an electromagnetic wave generator represented by the block 12 and located at a first end 2 of the rectangular section waveguide. The other end 3 of the waveguide 1 is closed.

A circular section waveguide 4 is connected to the rectangular section waveguide 1 by an opening 10 located on the large side of the rectangular section waveguide 1, near its closed end. The axes of the two waveguides are mutually perpendicular.

This waveguide 4 propagates the $TM_{01}$ mode because the distribution of the magnetic field in the rectangular waveguide 1, at the level of the opening 10, corresponds to that of the $TM_{01}$ mode in the circular section waveguide 4. The opening 10 in the rectangular waveguide 1 is large-sized, thus enabling operation at high power.

Corrective elements such as inductive rods, capacitive elements, irises or any other metallic or dielectric obstacles are used to enlarge the operating band. They are preferably interposed in the rectangular waveguide 1, but also in the circular waveguide 4.

The structure enables the conversion of the rectangular $TE_{10}$ mode into the circular $TM_{01}$ mode.

A group of intermediate waveguides 15 is located at the other end 9 of the circular waveguide 4. These intermediate waveguides 15 are distributed in a ring on the periphery of the circular waveguide 4.

In our example, there are four intermediate guides 15. There may be any number of these guides, but this number must nevertheless be greater than or equal to two. The greater this number, the more power it will be possible to transmit, and the purer will be the mode obtained at output. Each intermediate waveguide 15 consists of a succession of n waveguide pieces, 5, 5', 5'', ... $5^{n-1}$, placed end to end along an axis which extends the longitudinal axis of the circular waveguide 4. It is the first piece 5 of each intermediate waveguide 15 that is connected to the circular waveguide 4.

The cross-section of the waveguide pieces 5, 5', 5'' ... $5^{n-1}$ has a rectangular or similar shape: for example, trapezoidal, elliptic, with rounded corners, etc.

All the waveguide pieces 5, 5', 5'', ... $5^{n-1}$ are chosen to be monomode, and are supplied in phase. All the pieces of one and the same rank have the same length.

The large sides of their cross-section are gradually offset rotationally with respect to one another, in the same direction.

At least one large side of each first piece is cut in a substantially perpendicular direction by a radius of the circular waveguide 4.

The overall offset between the first piece 5 and the last piece $5^{n-1}$ of the same intermediate waveguide 15 is 90°. The rotational direction is the same for each of the intermediate waveguides.

FIG. 1 shows each intermediate waveguide 15, made up of three pieces 5, 5', 5''.

In one and the same intermediate waveguide 15, the second piece 5' is offset by 45° with respect to the first piece 5, and the last piece 5'' is offset by 45° with respect to the piece 5' and by 90° with respect to the first piece 5. A circular, output waveguide 8 is fixed on after the group of intermediate waveguides 15.

Figure 2A:
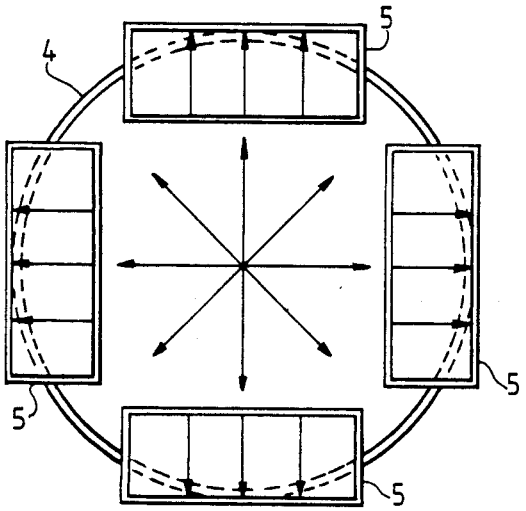
FIGS. 2*a* to 2*c* show cross-sections of the various elements of the mode converter according to the invention.

FIG. 2*a* shows, in a sectional view along the axis AA', the first waveguide pieces 5. The distribution of the electrical field is indicated inside each of them. The distribution of the electrical field in the circular waveguide 4 is also shown because the section is made towards the circular waveguide 4.

The rectangular $TE_{10}$ mode will be propagated in each of these pieces 5 because the distribution of the electrical field in the circular waveguide 4, at the opening 9 is along the radii of its cross-section. In the first waveguide pieces 5, this distribution will correspond to that of the rectangular $TE_{10}$ mode.

In order to obtain optimum operation, a compromise must be made between the dimensions of the first waveguide pieces 5 and the dimensions of the circular waveguides 4, as well as between each of the axes of the first waveguide pieces 5 and the axis of the circular guide 4.

The diameter of the circular waveguide 4, at the junction with the first pieces 5 forming the intermediate 15, may be different from the optimum diameter of the circular waveguide 4 used for the previous transition, namely for the conversion of the rectangular $TE_{10}$ mode into a circular $TM_{01}$ mode.

In this case, a transition of diameter should be incorporated between the circular waveguide 4 and the first pieces 5, comprising the intermediate waveguides 15. It is possible for this transition to be made by single jumps as shown at 6 in FIG. 1. This transition can also be made by successive jumps or gradually. In the latter case, a gradual connection element will be introduced.

Figure 2B:
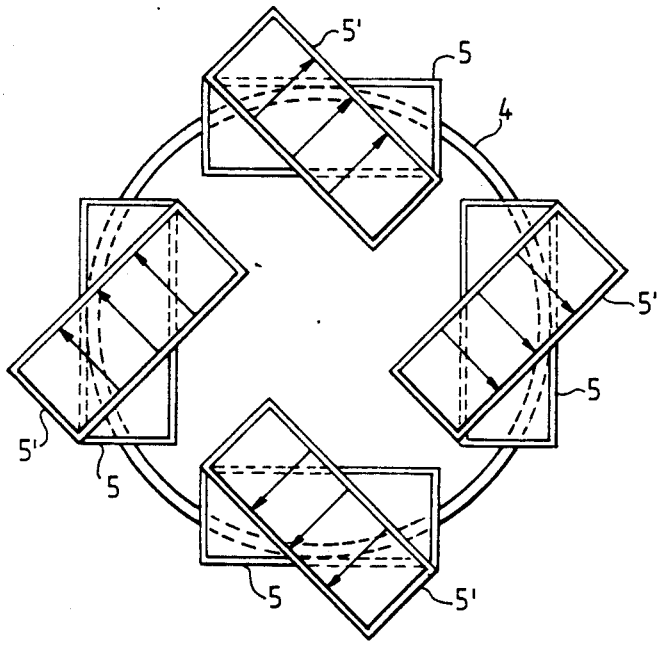

FIG. 2*b* shows a sectional view along the axis BB' of the second waveguide pieces 5' of intermediate waveguides 15. The section is made towards the circular waveguide 4.

These pieces 5' have their large sides offset by 45° with respect to the large sides of the pieces 5. They are both offset in the same direction.

The distribution of the electrical field is also shown. The rectangular $TE_{10}$ mode is also propagated inside these second waveguide pieces 5'.

Figure 2C:
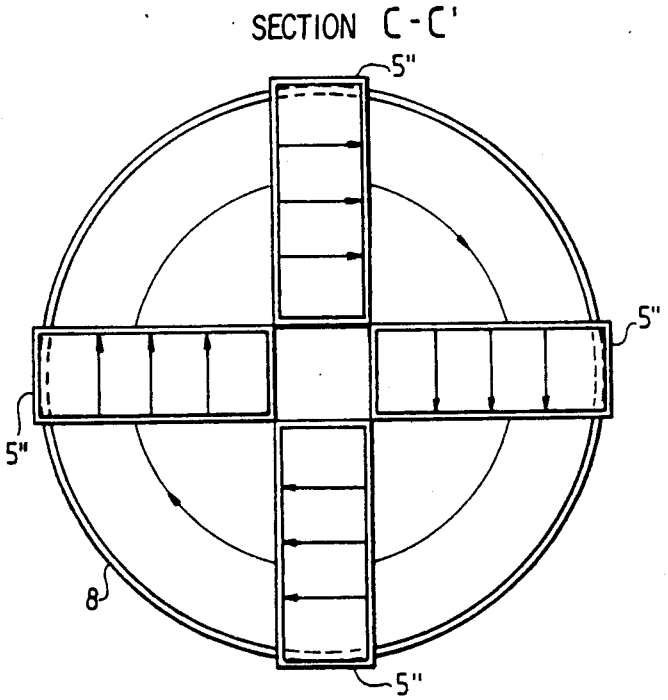

FIG. 2*c* shows a sectional view along the axis CC' of the last waveguide pieces 5'' comprising the intermediate waveguides 15.

These waveguide pieces 5'' are offset by 45° with respect to the pieces 5' shown in FIG. 2, and offset by 90° with respect to the first pieces 5 shown in FIGS. 2*a* and 2*b*.

The distribution of the electrical fields is indicated inside each waveguide piece 5''. The circular section, output waveguide 8 is fixed on after the last waveguide pieces 5'' forming the intermediate waveguides 15.

As previously, it is the last waveguide pieces 5'', forming the intermediate waveguide pieces 15, that are distributed in a ring on the periphery of the input 11 of the circular, output waveguide 8. However, this time, the large sides of the waveguide pieces 5'' are parallel to the radii of the circular waveguide 8.

In FIG. 2*c*, the circular, output waveguide 8 is shown for the section is made towards the output.

At the junction with the circular waveguide 8, since the electrical field in each waveguide piece 5'' is perpendicular to the radii of the circular, output waveguide 8, it is the circular $TE_{01}$ mode that will be propagated.

In order to obtain optimum operation, a compromise should be made between the dimensions of the last waveguide pieces 5″ and the circular, output waveguide 8 as well as between the distance between each of the axes of the last waveguide pieces 5″ and the axis of the circular, output guide 8.

FIGS. 3*a* to 3*f* show various possible cross-sections, other than rectangular ones, for the waveguide pieces 5, 5′, 5″ . . . $5^{n-1}$, forming the intermediate waveguides.

FIG. 3*a* shows a ring sector section.

FIG. 3*b* shows a trapezoidal section.

FIG. 3*c* shows a trapezoidal section with rounded corners.

FIG. 3*d* shows an elliptical section.

FIG. 3*e* shows a rectangular section with four convex sides.

FIG. 3*f* shows a trapezoidal section with four convex sides.

Other shapes can be used.

The shapes shown in these figures are particularly well-suited to making first waveguide pieces 5.

The sections shown in FIGS. 3*a* to 3*c* and 3*f* enable a maximum number of waveguide pieces 5 to be placed at the periphery of the circular waveguide because they are slightly trapezoidal.

The sections shown in FIGS. 3*d* to 3*f* will permit the transmission of greater power because of their convex sides.

FIGS. 4*a* to 4*d* show various possible shapes, other than rectangular ones, particularly matched to the cross-sections of the last waveguide pieces $5^{n-1}$. In this case, the large sides of these waveguide pieces are parallel to the radii of the circular, output waveguides 8.

Figure 4A:
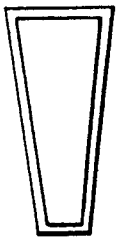
FIGS. 4*a* to 4*d* show various possible sections for the last intermediate waveguide pieces.
Figure 4B:
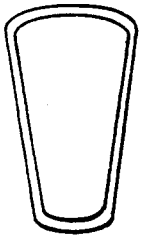
Figure 4C:
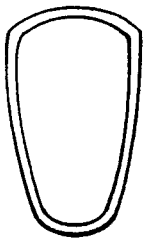
Figure 4D:
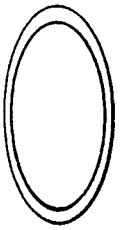

These sections are trapezoidal (FIG. 4*a*), trapezoidal with rounded corners (FIG. 4*b*), trapezoidal with four convex sides (FIG. 4*c*) or elliptical (FIG. 4*d*). Other shapes can be used.

The different waveguide pieces 5, 5′, 5″ . . . $5^{n-1}$, which form one and the same intermediate waveguide 15, will not necessarily have the same cross-section.

In order to improve the matching between intermediate waveguides 15 and the circular waveguide 8, corrections may have to be made by modification of the cross-section of the last waveguide pieces $5^{n-1}$.

The elements referenced 7 in FIG. 1 are clamps enabling one waveguide to be connected to another.

According to one variant, each intermediate waveguide 15 will be formed by a single waveguide twisted by 90° around its axis. The twist will be continuous.

The intermediate waveguides 15 will be all twisted in the same direction with the same pitch.

FIG. 5 shows an intermediate waveguide 15, twisted by 90° continuously.

A mode converter according to the invention, working in the 3.6 GHz to 3.8 GHz frequency band, with the following performance characteristics:

maximum standing-wave ratio: 1.05;

purity of converted mode: 98%, gives very satisfactory results.

It is formed by the following elements:

a rectangular $TE_{10}$ waveguide, the internal dimensions of which are: 72.14 mm. by 34.04 mm.;

a circular waveguide $TM_{01}$ with an internal diameter is 69 mm;

a transition connection element with an internal diameter of 85 mm.;

four intermediate waveguides, each made up of three identical, rectangular waveguide pieces working in the rectangular $TE_{10}$ mode. Their internal dimensions are 47.55 mm. by 22.15 mm.

The output of the mode converter is achieved by a circular waveguide working in the mode $TE_{01}$, the internal diameter of which is 120 mm.

What is claimed is:

1. A mode converter for microwave power transmission circuits, working at high power, interposed between an electromagnetic wave generator and a circular output waveguide propagating the circular $TE_{01}$ mode, said converter comprising:

a rectangular waveguide, working in its fundamental mode, $TE_{10}$, connected by one of its ends to the electromagnetic wave generator and having its other end closed;

a circular waveguide propagating the $TM_{01}$ mode, having a first end connected to the rectangular waveguide by a lateral opening, located on the large side of the rectangular waveguide near its closed end, in such a way that the axes of the two waveguides are perpendicular, said converter further comprising:

a group of intermediate waveguides, interposed between the circular waveguide propagating the $TM_{01}$ mode and the output waveguide, the intermediate waveguides being distributed in a ring before a second end of the circular waveguide propagating the $TM_{01}$ mode, each of said intermediate waveguides being realized by a sequence of n waveguide sections working in the rectangular $TE_{10}$ mode, the large sides of their cross-sections being gradually offset rotationally with respect to one another, in the same direction, in such a way that the first waveguide section of each intermediate waveguide has at least one of its large sides cut in a substantially perpendicular direction by a radius of the circular waveguide propagating the $TM_{01}$ mode, in such a way that the overall offset between the first waveguide section and the last waveguide section of one and the same intermediate waveguide is 90°,

2. A mode converter for microwave power transmission circuit according to claim 1, wherein each intermediate waveguide is formed by three waveguide sections placed end to end, the angle of rotation of the second section with respect to the first section being 45° and the angle of rotation of the last section with respect to the second section being also 45°.

3. A mode converter for microwave power transmission circuit according to claim 1, wherein each intermediate waveguide is formed by a single guide, working in the rectangular $TE_{10}$ mode, twisted by 90° continuously around its axis.

4. A mode converter for microwave power transmission circuit according to claim 3, wherein each of the intermediate guides is twisted, in the same direction, with the same pitch.

5. A mode converter for microwave power transmission circuit according to either of the claims 1 or 2, wherein the cross-section of the waveguide sections is substantially rectangular.

6. A mode converter for microwave power transmission circuit according to either of the claims 3 or 4, wherein the cross-section of the twisted, intermediate waveguides is substantially rectangular.

7. A mode converter for microwave power transmission circuit according to claim 1, wherein the shape of the cross-section of the waveguide sections forming one and the same intermediate waveguide is different.

* * * * *